United States Patent [19]

Stark et al.

[11] Patent Number: 5,040,460

[45] Date of Patent: Aug. 20, 1991

[54] SHEET REGISTER ADJUSTING ASSEMBLY

[75] Inventors: Siegfried A. Stark, Rottendorf; Erich G. Wieland, Würzburg, both of Fed. Rep. of Germany

[73] Assignee: Koenig & Bauer Aktiengesellschaft, Wurzburg, Fed. Rep. of Germany

[21] Appl. No.: 509,301

[22] Filed: Apr. 16, 1990

[30] Foreign Application Priority Data

Apr. 22, 1989 [DE] Fed. Rep. of Germany ..... 3913339

[51] Int. Cl.[5] ..... B41F 13/14; B41F 21/10

[52] U.S. Cl. ..... 101/232; 101/248

[58] Field of Search ..... 101/248, 181, 216, 232, 101/183

[56] References Cited

U.S. PATENT DOCUMENTS 3,884,146 5/1975 Ruetschle ..... 101/248

4,922,819 5/1990 Ishii ..... 101/248

FOREIGN PATENT DOCUMENTS 2720313 1/1978 Fed. Rep. of Germany .

*Primary Examiner*—J. Reed Fisher

*Attorney, Agent, or Firm*—Jones, Tullar & Cooper

[57] ABSTRACT

A sheet register adjusting assembly of a register drum of a sheet fed rotary printing machine uses axial displacement of the register drum to provide later register adjustment, and pivotal displacement of the register drum to provide circumferential register adjustment. Both lateral and circumferential register adjustments may be made in an accurate manner.

4 Claims, 3 Drawing Sheets

SHEET REGISTER ADJUSTING ASSEMBLY

FIELD OF THE INVENTION

The present invention is directed generally to a sheet register adjusting assembly. More particularly, the present invention is directed to a lateral and circumferential sheet register adjusting device. Most specifically, the present invention is directed to a lateral and circumferential sheet register adjusting assembly for a register drum of a sheet-fed rotary printing machine. The sheet register adjusting assembly is carried on a register drum which has a gear wheel that is in spur gear meshing engagement with a first sheet transfer drum that is positioned before, in a sheet feeding director, of the register drum. The sheet register adjusting assembly provides for both lateral and circumferential adjustment of the sheet gripping apparatus on the register drum.

DESCRIPTION OF THE PRIOR ART

Various devices that are useable to correct register errors in sheet-fed rotary printing machines are known generally in the prior art. These devices are often utilized to adjust or vary the positioning of a sheet of printed material as it is being transferred between serially positioned printing drums. If an error in color or print register is noted on the final product, these various sheet register adjusting devices can be used to correct the position of the sheet so that it is in proper register or position as it is transferred between printing drums.

One prior art device that is useable to adjust the lateral and circumferential register of a sheet is shown in German published unexamined application 2720313. In this device, lateral register is adjusted by effecting an axial displacement of the transfer cylinder. A roller engages a connecting link which is arranged in a cylinder journal end, which, in turn, is rotatably fixed on a pivotable lever. The pivotable lever is adjustable by means of a handwheel that uses a worm gear drive to shift one end of the pivotable lever. As the lever is pivoted, the cylinder journal end may be moved in an axial direction to cause lateral register changes.

In this prior art device, circumferential register adjustment is effected by axial displacement of a gear rim. This gear rim is axially displaceable on the shaft journal end by use of a sliding key and keyway that allows the gear rim to be axially displaceable on the shaft journal while remaining rotatably fixed to the shaft journal. The exterior surface of this gear rim is provided with helical teeth which mesh with cooperatively shaped helical gear teeth on a following gear. The gear rim may be axially displaced by pivoting a roller that is meshing with a connection link fixed on the gear rim. This roller is rotatably fixed on a lever that is pivotable by use of a handwheel and a worm gear drive. Axial displacement of the gear rim that is caused by the helical gear teeth causes a rotation of the gear rim and a circumferential rotation or circumferential register adjustment of the cylinder that is keyed to the gear rim.

In prior art devices of this type generally, and in the prior device disclosed in the German published unexamined patent application 2720313, the circumferential register adjustment can be made only in a course manner. This is because there exists a clearance or space between the gear rim supported loosely on the shaft journal of the cylinder and the shaft. This clearance does not allow a fine adjustment of the circumferential register to be accomplished.

It will be apparent that a need exists for a sheet register adjustment assembly which will allow accurate and precise lateral and circumferential sheet register adjustments to be made in an effective manner. The sheet register adjusting assembly of the present invention provides such a device and is a substantial improvement over prior art devices.

SUMMARY OF THE INVENTION

It is an object of the present invention to provide a sheet register adjusting assembly.

Another object of the present invention is to provide a lateral and circumferential sheet register adjusting assembly.

A further object of the present invention is to provide a lateral and circumferential sheet register adjusting assembly for a sheet-fed rotary printing machine.

Yet another object of the present invention is to provide a sheet register adjusting assembly for a register drum of a hybrid printing machine having an offset printing unit and a gravure printing unit.

Even a further object of the present invention is to provide a lateral and circumferential register adjusting assembly in which a gear provided for the drive of the register drum is in gear drive connection with only one other gear.

Still even another object of the present invention is to provide a sheet register adjusting assembly which is finely and quickly adjustable.

As will be discussed in detail in the description of the preferred embodiment which is set forth subsequently, the sheet register adjusting assembly in accordance with the present invention provides for both lateral and circumferential sheet register adjustments. The sheet register drum is positioned between, in the direction of sheet travel, a pair of sheet transfer drums. The register drum is also in gear mesh contact with the sheet transfer drum which precedes it. Lateral sheet register adjustment is effected by sliding the sheet gripping portion of the register drum axially along the axis of rotation of the drum. An adjusting motor is driven by a pulse generator and causes a control disk to pivot. A control roller is carried by the gripper supports and rides on this control disk. Movement of the control disk thus causes a lateral shifting of the sheet grippers on the register system.

Circumferential register adjustment is also effected by an adjustment motor that is driven by a pulse generator. This motor causes switch rods to move in a direction generally perpendicular to the axis of rotation of the sheet grippers. This movement of switch rods causes spaced lever arms to pivot and to shift the axis of rotation of the sheet grippers. The point of gear mesh engagement of the register drum with the preceding, in the direction of sheet travel, transfer drum does not change.

The sheet register adjusting assembly of the present invention provides several advantages over the prior art devices. In particular, the present sheet register adjusting assembly allows very fine, accurate register adjustments to be made. This is very beneficial in conjunction with printing machines that are used to print security documents. In machines of this type, very accurate sheet register is important and any errors must be corrected quickly and correctly.

The present invention may also be provided with an automatic control system in an expeditious manner.

During a press run, each sheet can be measured individually for any register problems. If any register errors are noted, the sheet register adjusting assembly of the present invention can automatically effect both lateral and circumferential corrections.

The sheet register adjusting assembly of the present invention allows fine lateral and circumferential register adjustments in an automatic manner. As such, it provides a significant advance in the art.

BRIEF DESCRIPTION OF THE DRAWINGS

While the novel features of the sheet register adjusting assembly in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
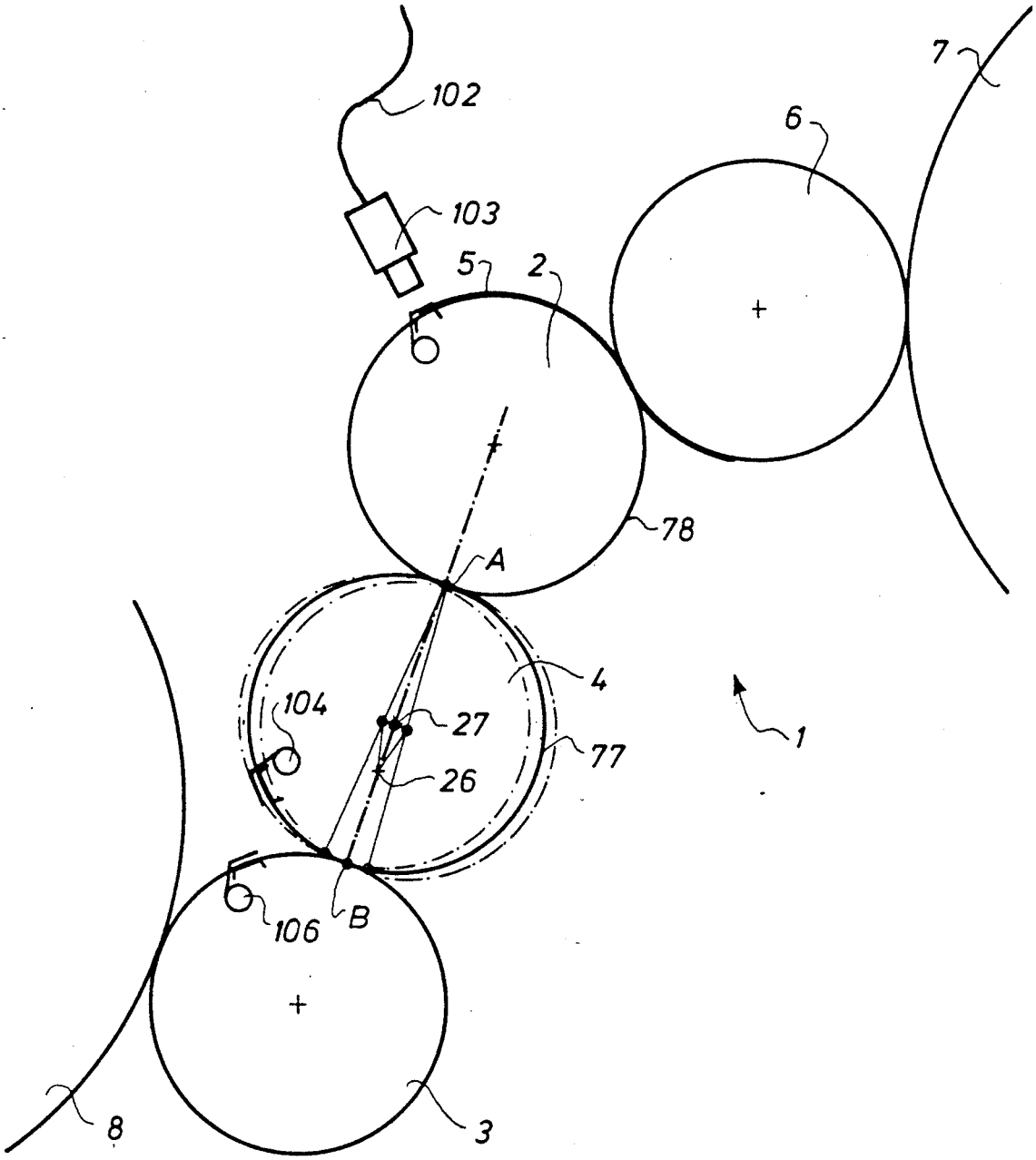
FIG. 1 is a schematic side elevation view of a portion of a printing machine and showing a register drum in accordance with the present invention.

Referring initially to FIG. 1, there may be seen, generally at 1, a preferred embodiment of a sheet register adjusting assembly in accordance with the present invention. In the depicted roller or cylinder train, a register drum 4 which is used to adjust the lateral and circumferential register of sheets, is positioned between a leading, or first sheet transfer drum 2 and a trailing, or second sheet transfer drum 3. It will be understood that terms such as "leading" and "trailing" or "before" and "after" refer to position with regard to the direction of sheet travel in the sheet register adjusting assembly. As seen in FIG. 1, a sheet 5 is released from a storage drum 7 to a reversing drum 6 and then to the first or leading transfer drum 2. After the sheet has been released from the register drum 4, it passes to a second or trailing transfer drum 3 and then goes to an impression cylinder 8. All of these drums or cylinders, with the exception of the register drum 4 are directly rotatably supported in spaced side frames 9 and 11 of the rotary printing machine. Further, all of these cylinders 2, 3, 6, 7 and 8 are generally conventional in construction and operation.

Figure 2:
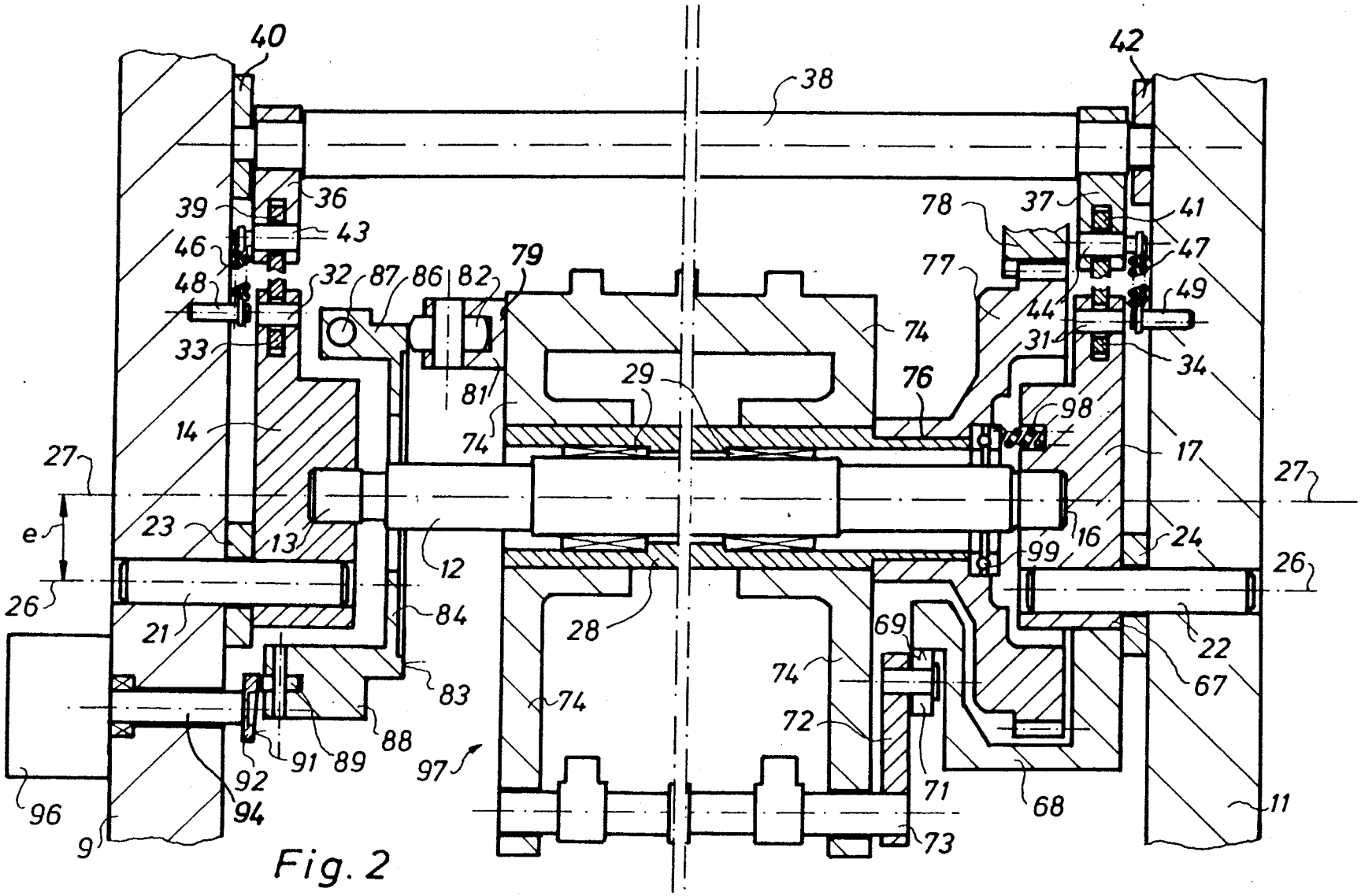
FIG. 2 is a cross-sectional view of a register drum having the sheet register adjusting assembly of the present invention.
Figure 3:
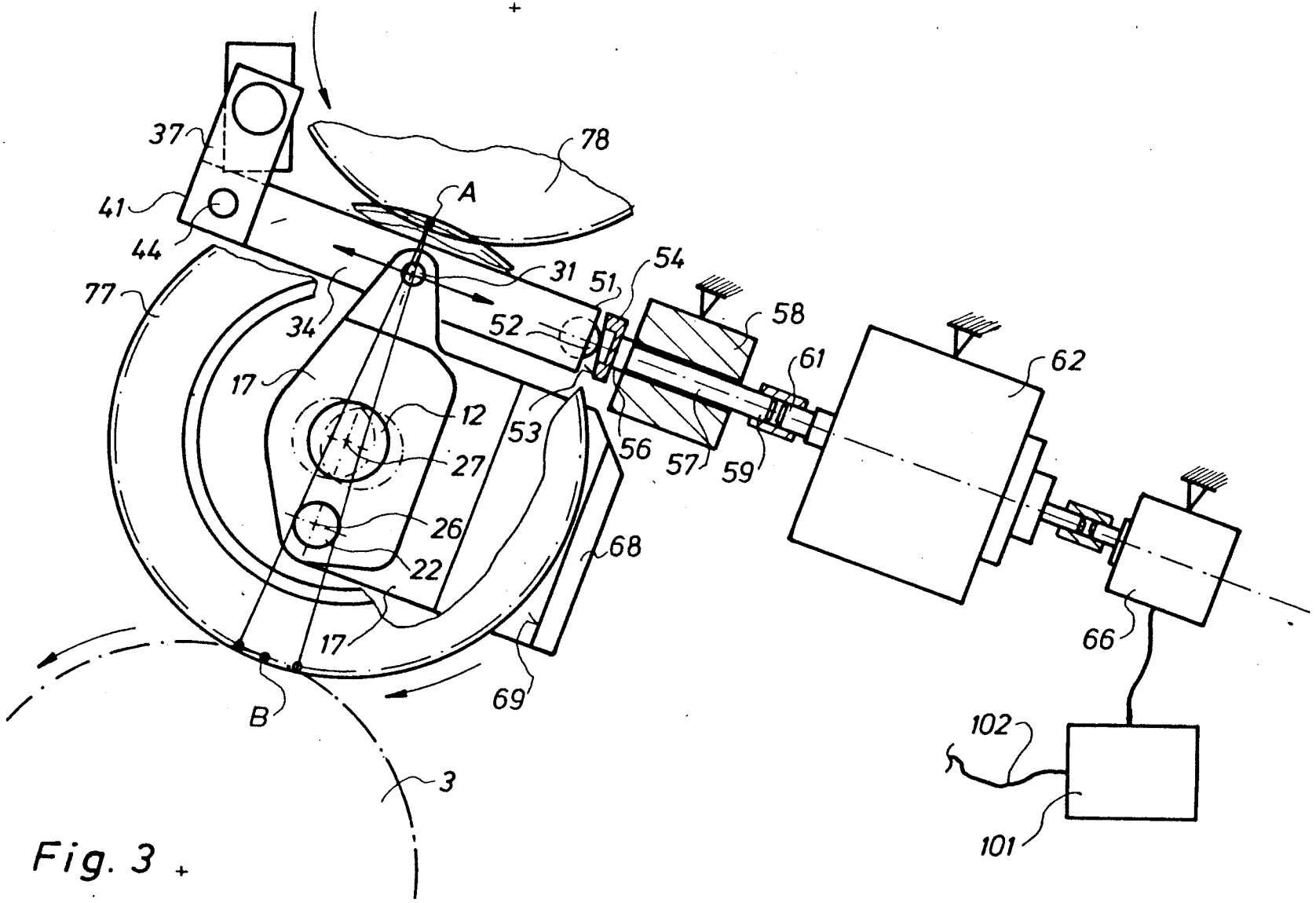
FIG. 3 is a side elevation view of the register drum of FIG. 2, partly in cross-section and with portions removed for clarity.

Register drum 4 is shown in greater detail in FIGS. 2 and 3 and provides the sheet register adjusting assembly of the present invention. An inner, fixed shaft 12 is securely connected to a left side lever 14 at its left end 13, and to a right side lever 17 at its right end 16. The right side lever 17 may be seen more clearly in FIG. 3. Each of the side levers 14 and 17 are pivotably supported by corresponding left and right side pivot pins 21 and 22 which, as is shown in FIG. 2, are tightly positioned in the side frames 9 and 11, respectively of the printing machine. Suitable spacer washers 23 and 24 are interposed between the levers 14 and 17 and the side frames 9 and 11 to space the levers from the side frames. Both of these levers 14 and 17 have a common first axis of rotation 26 and this axis is spaced a distance "e" from a second axis of rotation 27 of a second, outer shaft 28 which is concentric with, and rotatably supported on fixed inner shaft 12. Outer shaft 28 is supported by suitable needle bearing assemblies 29 so that is both rotatable about, and axially shiftable with respect to fixed inner shaft 12.

Referring to FIGS. 2 and 3, left lever 14 and right lever 17 are each joined, adjacent their upper ends, to left and right switch rods 33 and 34, respectively by bolts 32 and 31 or other suitable connecting devices. These two switch rods 33 and 34 are generally parallel to each other and are each connected at first ends 39 and 41 to a synchronization shaft 38. As may be seen most clearly in FIG. 2, synchronization shaft 38 is supported in bearing brackets 40 and 42 that are fixed to the side frames 9 and 11. Connecting rods 36 and 37 are securely attached to the outer ends of the synchronization shaft 38. A bolt 43 or 44 in the lower end of the connecting rod 36 or 38 joins each connecting rod to the first end 39 or 41 of one of the switch rods 33 or 34, respectively. This insures that the two switch rods 33 and 34 will move in unison since a force applied to one switch rod will be transferred through the appropriate bolt and connecting rod to the synchronization shaft 38 and thence to the opposite connecting rod and bolt and to the opposite switch rod. Each of the connecting rod bolts 43 and 44 extends through its connecting rod 36 or 37 and carries a spring 46 or 47 on its end adjacent side frame 9 or 11. A second end of each of these springs 46 and 47 is attached to a pin 48 or 49 that is carried by the side frames 9 and 11. These springs 46 and 47 provide a restorative force to the connecting rods 36 and 37 and to the switch rods 33 and 34.

Turning now primarily to FIG. 3, a second end 51 of right switch rod 34 carries a rotatably supported control roller 52. This control roller 52 is in contact with an axially aligned contoured surface 53 of a first adjustable control cam 54. This control cam 54 is securely connected to a first end 56 of a control shaft 57. The control shaft 57 is, in turn, rotatably supported in a bearing bracket 58 carried by the side-frame 11. A second end 59 of control shaft 57 is positively coupled with a drive shaft 61 of an adjusting motor 62. A pulse generator 66 is connected to the adjusting motor 62. Electrical pulses generated by pulse generator 66 are used to actuate the adjusting motor 62 and to rotate the drive shaft 61. This, in turn, rotates the control shaft 57 and causes the adjustable control cam 54 to rotate. Changes in the position of control cam 54 will cause right switch rod 34 to move in the direction of the arrows shown in FIG. 3.

As may be seen in both FIGS. 2 and 3, one lower end 67 of the right side lever 17 is tightly connected with a control cam 68 that has a radially aligned contour 69 which is in contact with a first control roller 71. This control roller 71 is rotatably supported on a lever 72 which is tightly connected with a sheet gripper shaft 73. The gripper shaft 73 is pivotably supported in supports 74 which are tightly positioned on the outer shaft 28. On a right end 76 of the outer shaft 28, a first gear wheel 77 is also tightly connected with this outer shaft 28. The first gear wheel 77 meshes with a second gear wheel 78 of the transfer drum 2 which is positioned ahead of, or before the register drum 4. This second gear wheel 78 drives the first gear wheel 77 and thus causes the rotation of the supports 74 and hence the sheet gripper shaft or shafts 73.

Returning again to FIG. 2, a bearing block 81 is securely attached to a left outer side surface 79 of one of the supports 74 for the sheet gripper shaft 73. This bearing block 81 rotatably supports a second control roller 82. The control roller 82 is in contact with a ring-shaped front face 83 of a vertically arranged control disk 84 that is pivotable toward and away from the outer side 79 of the register drum 4. At its upper end 86, the control disk 84 is pivotably supported around a journal 87 which is fixed to the side-frame. Control disk 84 is provided, at its lower end 88, with a rotatably supported third control roller 89. This control roller 89 is in contact with an axially aligned contour face 91 of a second control disk 92 and rolls on face 91. The control disk 92 is fixed on a first end of a control shaft 94 which is rotatably supported in the side wall 9. The control shaft 94 is driven by an adjusting motor 96 that is also supported on the side wall 9. For the application of a restoring force to the carriage 97 which includes the outer shaft 28, gear wheel 77 and supports 74, and which may be shifted axially by control disks 84 and 92, several compression springs 98 are provided and support themselves axially on the lever 17 and act on a thrust bearing 99 which supports itself on the outer shaft 28.

Each of the two adjusting motors 62 and 96 may be connected by suitable electric lines (not shown) to a computer unit 101 that is connected by an electric line 102 to a reading device 103, as seen in FIG. 1. The reading device 103 is, as depicted in FIG. 1, positioned at a distance from the first transfer drum 2 and serves to determine the position of a sheet 5 taken from the reversing drum 6. A signal characterizing the position of the sheet 5 is transmitted to the computer unit 101 and is compared with corresponding nominal values for the lateral and circumferential positions. Simultaneously, the computer unit 101 receives a signal from the pulse generator 66 indicating the position of the control cam 54 and from a second pulse generator (not shown) indicating the position of the control cam 92. From these input signals, the computer unit 101 can be used to calculate adjusting values and transmit them as control commands to the adjusting motors 62, 96. Alternatively, instead of using a computer unit 101, other suitable devices could be utilized to ascertain a register error and to operate either one or both of the two adjusting motors 62 and 96, either manually or automatically, to bring the sheet into correct registry.

Referring initially to FIG. 3, when the circumferential register adjustment of a sheet carried by the gripper shaft 73 of the register drum 4 is to be effected, the adjusting motor 62 is operated and causes the control shaft 57 to be rotated either to the right or to the left. As discussed above, the rotation of the control shaft 57, and hence the control cam 54 by the adjusting motor 62, is in response to the position of the sheet 5 on the first transfer drum 2. In accordance with the contour 53 of the control cam 54, the switch rod 34 is displaced by means of the control roller 52 against the force of the compression springs 46 and 47. The right lever 17, which is hinged to the switch rod 34, is pivoted around the axis of rotation 26 of the bolt 22. The left lever 14 is pivoted around the bolt 21 in a similar manner by the connecting rods 36 and 37, and the synchronization shaft 38. Concurrently, the axis of rotation 27 of the inner shaft 16 moves on a circle around the axis of rotation 26 of the bolts 21 and 22, as is depicted in FIG. 3. The pivoting angle is small so that the circular movement can be considered as rectilinear displacement of the inner shaft 12. Due to the mesh of the gear wheels 77 and 78, the gear wheel 77 and thus the carriage 97 are pivoted around the meshing point A between the gear wheels 77 and 78. This point of gear meshing A is also the transfer point A between the first transfer drum 2 and the register drum 4. This transfer point A is constant and does not change its position. The second transfer drum 3 is not meshing with the register drum 4 and is not rotated. This results in a relative movement of the transfer point B, as seen in FIGS. 1 and 3 between the grippers 104 of the register drum 4 and the grippers 106 of the transfer drum 3. Since the position of the transfer point B is changeable, the grippers 104 and 106 are disposed in such a way that they can grip the sheet 5 in register over an area of sufficient size (approx. 3 mm) and keep it. Displacement of the right switch rod 34 in a direction to the left causes the register drum 4 to be pivoted clock-wise and thus the transfer point B is displaced to the left or forward as seen in sheet transport direction.

Referring now primarily to FIG. 2, adjustment of the lateral register is effected by actuating the second or lateral adjusting motor 96. This second or lateral register adjusting motor 96 rotates right or left, depending on the position of the sheet 5 on the transfer drum 2, so that the control cam 92 is pivoted correspondingly. Due to the contour 91 of the control cam 92, the control disk 84 is pivoted around the bolt or pivot journal 87 by means of the control roller 89 so that the control roller 82, when rolling on the front face 83 of the control disk 84, axially displaces the carriage 97 towards or against the restoring force of the compression springs 98. This axial displacement of the carriage 97 is accomplishable because of the axial sliding allowed by the needle bearings 29 which support the outer shaft 28 of the carriage 97 on the inner shaft 12.

In the preferred embodiment of the sheet register adjusting assembly discussed above, the two switch rods 33 and 34 are described as both being joined to the synchronization shaft 38 by the connecting rods 36 and 37. It is also within the scope of the present invention to remove the synchronization shaft 38 or alternatively to disconnect the left and right side levers 14 and 17 and their associated switch rods 33 and 34 from it. In this configuration, a second circumferential register adjusting assembly, including a second pulse generator 66, a second control shaft 57, a second adjustable control cam 54 and a second control roller 52 may be provided for the left switch rod 33. In this configuration, independent control of the left and right switch levers 14 and 17 may be accomplished. This will allow the register drum 4 to be adjusted circumferentially in a skewed manner to be able to correct skew faults of sheets 5.

While a preferred embodiment of a sheet register assembly in accordance with the present invention has been set forth fully and completely hereinabove, it will be apparent to one of skill in the art that a number of changes in, for example, the sizes of the various cylinder, the type of sheet grippers, and the type of reading device and the like may be made without departing from the true spirit and scope of the invention which is accordingly to be limited only by the following claims.

What is claimed is:

1. A sheet register adjusting assembly usable to effect circumferential adjustments of a register drum in a sheet fed rotary printing machine, said sheet register adjusting assembly comprising:

a first sheet transfer drum positioned before, in sheet feeding direction, said register drum;

a second sheet transfer drum positioned after, in sheet feeding direction, said register drum;

a first gear wheel on said first sheet transfer drum;

a second gear wheel on said register drum;

a constant gear meshing point formed where said first gear wheel meshes with said second gear wheel;

a constant transfer point between said first transfer drum and said register drum at said constant gear meshing point;

a shiftable transfer point between said register drum and said second sheet transfer drum; and means to support said register drum for eccentric pivotable movement about said constant gear meshing point and to effect shifting of said shiftable transfer point between said register drum and said second sheet transfer drum.

2. The sheet register adjusting assembly of claim 1 wherein said register drum is supported on a support shaft and further wherein said support shaft is supported at its ends in spaced first and second pivotable levers.

3. The sheet register adjusting assembly of claim 2 wherein first ends of spaced first and second switch rods are connected to said first and second pivotable levers and second ends of said first and second switch rods are connected to first ends of first and second connecting rods and further wherein a synchronization shaft is joined to second ends of said first and second connecting rods whereby said first and second pivotable levers are interconnected to each other.

4. The sheet register adjusting assembly of claim 3 further including an adjustable control cam having a contoured surface and wherein a second end of at least one of said first and second switch rods is in contact with said contoured surface to effect eccentric pivotable movement of said register drum about said constant gear meshing point.

* * * * *